United States Patent [19]

Bremer

[11] Patent Number: 5,021,027

[45] Date of Patent: Jun. 4, 1991

[54] COIN COMPUTER WITH INTEGRAL COIN INDICIA

[76] Inventor: John D. Bremer, 2 Poe Ave., Somerset, N.J. 08873

[21] Appl. No.: 344,091

[22] Filed: Apr. 27, 1989

[51] Int. Cl.[5] ..... G07D 9/06

[52] U.S. Cl. ..... 453/58; 453/60; 453/63; 53/532

[58] Field of Search ..... 453/58, 59, 60, 61, 453/62, 63; 53/212, 213, 254, 532

[56] References Cited

U.S. PATENT DOCUMENTS

| | | | |
|---|---|---|---|
| 208,902 | 10/1878 | Fuller | 453/60 |
| 1,160,255 | 11/1915 | Buchrim . | |
| 1,407,140 | 2/1922 | Friesen . | |
| 2,215,858 | 9/1940 | Slootsky . | |
| 2,549,299 | 4/1951 | Drury | 453/60 X |
| 3,093,148 | 6/1963 | Mesthos . | |
| 3,163,170 | 12/1964 | Gates | 453/61 |
| 3,346,109 | 10/1967 | Duran | 453/60 X |
| 4,036,358 | 7/1977 | Kelley | 453/61 X |
| 4,109,668 | 8/1978 | Malacheski . | |
| 4,399,071 | 7/1982 | Hall | 453/61 X |
| 4,492,243 | 1/1985 | Lombard | 453/59 |
| 4,545,394 | 10/1985 | Chang | 453/60 |

FOREIGN PATENT DOCUMENTS

| | | | |
|---|---|---|---|
| 0632030 | 12/1961 | Canada | 453/60 |
| 0018490 | of 1897 | United Kingdom | 453/60 |

*Primary Examiner*—David H. Bollinger
*Assistant Examiner*—Dean A. Reichard
*Attorney, Agent, or Firm*—Arthur L. Plevy

[57] ABSTRACT

A coin counter comprises a longitudinal tubular member or a cylinder of a semicircular cross section and has a large longitudinal slot directed from the top opening to a closed bottom surface. The cylindrical member has graduations on the side thereof indicative of the height of various stacks of coins. One uses the member to scoop up similar coins and to capture the same inside the confines of the member whereby the graduations on the surface of the member define the exact height of a stack of coins and therefore the exact amount of a stack of coins. The device can further be used to assist in wrapping coins of the same denominations after being gathered by the coin counter.

3 Claims, 1 Drawing Sheet

COIN COMPUTER WITH INTEGRAL COIN INDICIA

BACKGROUND OF THE INVENTION

This invention relates to a coin counting apparatus and more particularly to a simple cylindrical scoop-like configuration which can accommodate different coin denominations in order to count and thereafter aid in wrapping coins.

As one can ascertain, the prior art is replete with numerous patents which relate to the holding and counting of coins, tokens or similar articles. Reference is made to U.S. Pat No. 1,160,255 which issued Nov. 16, 1915 to M. Buchrim and entitled "Coin Or Token Holder". This patent shows a cylinder for holding coins or tokens. The coins or tokens are of the same diameter and the device is used for holding coins of the same value while indicating the total amount of the coins.

U.S. Pat. No. 1,407,140 to T. F. Friesen issued on Feb. 21, 1922 and is entitled "Coin Stacker". This patent shows a coin wrapper which has a funnel on the top and a cylindrical coin receiving receptacle at the bottom end. The cylindrical coin receiving receptacle is comprised of inner tubes which are removable and where the tubes are replaced to count different types of coins.

U.S. Pat. No. 2,215,858 issued Sept. 24, 1940 to M. L. Slookski and entitled "Coin Packer". This patent shows a coin packer which consists of different semi-cylindrical members used to stack and wrap coins of different sizes.

U.S. Pat. No. 3,093,148 issued June 11, 1963 to G. A. Mesthos and entitled "Portable Coin Counter". This patent shows a portable coin counter which uses different sized cylinders for counting different sized coins.

U.S. Pat. No. 4,109,668 issued on Aug. 29, 1978 to J. J. Malacheski and entitled "Coin Counter". This patent shows a coin counter which essentially is a single device and has channels for accommodating various sized coins, such as nickles, dimes and so on. The device also operates in conjunction with a coin wrapper in order to enable one to efficiently wrap coins.

As one can ascertain from the prior art, as indicated above, there are many devices which will count and aid in wrapping or otherwise determining the number of different sized coins such as nickles, dimes and so on. As one can also ascertain, much of the above-noted apparatus is relatively complicated, requires different sized cylinders or multiple cylindrical or other configurations in order to accommodate the various sized coins. Thus the apparatus is difficult to manufacture at economical costs.

It is an object of the present invention to provide an improved coin counting apparatus which enables one to accommodate various size coins utilizing a single counting member which counting member also enables a user to wrap a stack of same denomination coins in a simple and efficient manner.

SUMMARY OF THE INVENTION

A coin counter apparatus comprising a longitudinal tubular member having a semicircular cross section and a supporting bottom surface with an opened top to form a coin scoop entrance and means on a surface of said device to provide reference levels indicative of defined numbers of like coins when stacked from said bottom surface towards said top and aligned within said member.

DETAILED DESCRIPTION OF THE FIGURES

Figure 1:
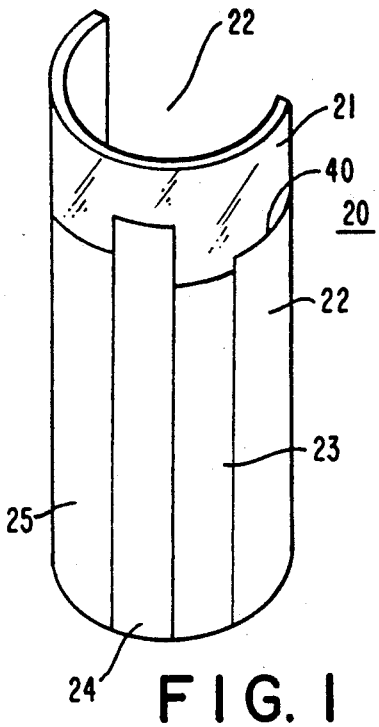
FIG. 1 is a plan view of a coin counter according to this invention.

Referring to FIG. 1 there is shown a coin counter 20 according to this invention. As one can ascertain from FIG. 1, the coin counter 20 is a longitudinal tubular member 21 basically shown as a cylinder. The cylinder has a semicircular cross section and an extensive longitudinal opening 22 directed from the top to the bottom of the cylinder which is more clearly shown in FIG. 3. The cylinder preferably is fabricated from a clear transparent plastic and has painted or otherwise marked on the surface thereof a plurality of colored bars or indicia, as 22, 23, 24, 25. These color bars are indicative of the length of a typical stack of coins. For example, the color bar 22 is of a length indicative of a stack of quarters which would constitute 40 coins or $10 which is the number of quarters required in a roll. The color bar 23 may, for example, be blue and indicative of a roll of dimes which would be 50 coins or $5. The color bar 24 may be red and indicative of the height of a stack of 50 pennies or 50 cents, while the color bar 25 may be yellow and indicative of a height of a stack of nickels which is 40 coins or $2.00. As one can ascertain, while U.S. coins are being employed, it is understood that various other currency from other countries can be accommodated by the techniques and the apparatus described. While a cylindrical configuration is preferred, other cross sectional members can be employed as well. The colored bars as described can be replaced with other means as reference lines, longitudinal slots and so on.

Figure 2:
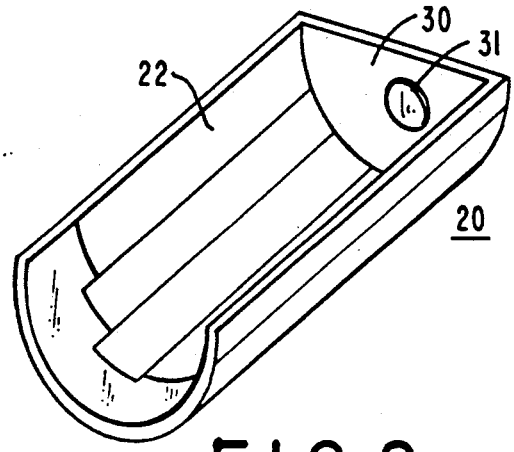
FIG. 2 is a perspective view of the coin counter.

As one can ascertain, the cylinder as shown in FIG. 2 basically has a cross-section of a semicircle and has a bottom back wall 30 with the extensive longitudinal opening 22. The cylinder, as shown in FIG. 2, appears much like a scoop device. In this manner the front opened end acts as a scoop entrance to enable one to use the device to scoop or pick up coins as will be explained.

Figure 3:
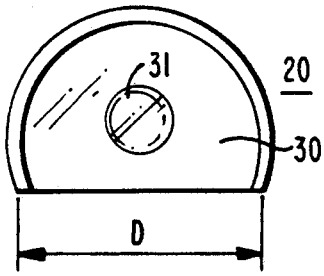
FIG. 3 is a top view of the coin counter.

Referring to FIG. 3 there is shown a top view of the cylinder or coin counter 20.

Figure 4:
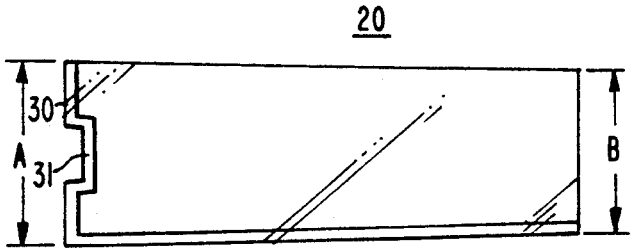
FIG. 4 is a side view of the coin counter.

FIG. 4 shows a side view of the coin counter 20. It is noted that there is a projection 31 on the bottom surface 30 of the coin counter. This provides a flat reference area to accommodate a stack of coins directed from the bottom surface to the top opening to further assure proper calibration. Essentially the coin counter is approximately 3-¾ inches long, is 1-⅜ inches at back, dimension A and is approximately 1-¼ inches at the front, as dimension B. The wall thickness is approximately 1/24th of an inch and the opening or dimension D, as shown in FIG. 3, is about ½ inch or 7/16ths of an inch. It is noted that the cylinder is dimensioned to accommodate the largest diameter coin which in regard to this example is the quarter, but can accommodate any type of coin if the dimensions are varied such as half dollars or dollars.

The device acts as a scoop and hence the cylinder has the dimension D greater than the maximum coin diameter to be accommodated, with the inner wall acting as a support to enable stacking of the coins in the vertical direction as from the bottom surface 30 towards the top opening.

Figure 5:
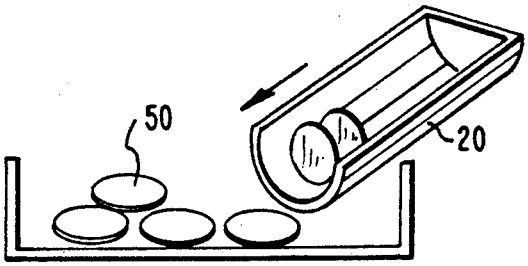
FIG. 5 is a plan view showing the operation of the coin counter and scoop device according to this invention.

Referring to FIG. 5, the operation and use of the device is as follows. Coins 50 are first separated into similar groups, for example in boxes or in piles. Hence one would separate the quarters, dimes and nickels into separate piles as shown in FIG. 5. One then takes the device 20 and scoops coins in the pile attempting to scoop up as many coins as possible. Then once the coins are in place as within the cavity of the member 20, one now shakes the member so that the coins will align in a stack using the inner wall of the cylindrical member to act as a support. Then all extra coins are removed or additional coins added so that one now obtains a stack of coins where the last coin is at the top of the appropriate end marking 40 of the color bar (FIG. 1), which is the reference line to form a proper roll of similar coins.

Now one takes a coin wrapper, which is a typical open cylindrical piece of paper and pouches the wrapper, places the wrapper over the first several coins in the stack and uses his index finger of the hand holding the coin counter to tilt a whole row of coins into the wrapper and slide the wrapper down over the entire row and then seal up the ends of the wrapper.

As one can see, the above-described device is extremely simple to implement, utilizes a single plastic member to accommodate the different diameter type coins and has reference markers to enable one to stack the coins appropriately to thereby obtain an accurate count of coins and thereafter utilize the device to enable stacking of the coins in a simple and reliable manner.

I claim:

1. A coin counter apparatus comprising:

a longitudinal transparent tubular member having a closed bottom defined by a bottom wall and an open top and a sidewall therebetween and having a substantial elongated opening along one side directed from said opened top to said closed bottom wherein said opened top enables said member to function as a scoop to scoop up coins of one of a plurality of different denominations, said longitudinal tubular member being semicircular in cross section with said substantial elongated opening being a rectangular slot to enable said member to scoop coins, and means located on the surface of said member to provide a plurality of reference levels, each one of said reference levels indicative of the height of a corresponding stack of different denomination coins whereby when one scoops coins of the same denomination into said member one can determine the exact amount of coins when said stack is aligned within said member from said bottom towards said top and supported by said wide walls of said member, said means comprising a plurality of individual color coded bars imprinted side-by-side on the outer surface of said member and extending from the bottom toward the opened top with each bar of a different length and color and with each bar corresponding to a different stack of different denomination coins, whereby said plurality of bars are four in number with a first bar corresponding to a stack of quarters, a second bar corresponding to a stack of dimes, a third bar corresponding to a stack of pennies and a fourth bar corresponding to a stack of nickels, the coin value of each bar being the accepted value for the particular associated coin, and an indentation in said bottom wall extending into the interior of said tubular member and providing a reference level for each stack of coins to rest on whereby an accurate measure of each stack of coins is obtained.

2. A coin counter apparatus according to claim 1, wherein said first bar corresponds to a stack of 40 quarters, said second bar corresponds to a stack of 50 dimes, said third bar corresponds to a stack of 50 pennies and said fourth bar corresponds to a stack of 40 nickels.

3. A coin counter apparatus according to claim 1, wherein said member is 3.75 inches in length with said semicircle having an effective circular diameter of 1.25 inches.

* * * * *